US011118486B2

(12) United States Patent
Bell

(10) Patent No.: US 11,118,486 B2
(45) Date of Patent: Sep. 14, 2021

(54) ROTOR TIMING FEATURE FOR CAMSHAFT PHASER

(71) Applicant: Schaeffler Technologies AG & Co. KG, Herzogenaurach (DE)

(72) Inventor: Shannon Bell, Sterling Heights, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/254,713

(22) Filed: Jan. 23, 2019

(65) Prior Publication Data

US 2020/0232352 A1 Jul. 23, 2020

(51) Int. Cl.
*F01L 1/344* (2006.01)

(52) U.S. Cl.
CPC ... *F01L 1/3442* (2013.01); *F01L 2001/34456* (2013.01); *F01L 2001/34469* (2013.01); *F01L 2001/34483* (2013.01)

(58) Field of Classification Search
CPC ..... F01L 1/3442; F01L 1/344; F01L 1/026; F01L 1/46; F01L 2001/34456; F01L 2001/34469; F01L 2001/34483; F01L 2001/34453; F01L 2001/3445
USPC ..... 123/90.15, 90.16, 90.17
See application file for complete search history.

(56) References Cited

U.S. PATENT DOCUMENTS

| | | | | |
|---|---|---|---|---|
| 6,477,999 | B1 | 11/2002 | Markley | |
| 6,745,735 | B2 | 6/2004 | Smith | |
| 8,973,542 | B2 * | 3/2015 | Morehead | F01L 1/3442 123/90.17 |
| 2007/0056539 | A1 * | 3/2007 | Fischer | F01L 1/3442 123/90.17 |
| 2010/0075765 | A1 * | 3/2010 | Isenberg | F01L 1/3442 464/160 |
| 2010/0300388 | A1 * | 12/2010 | Lang | F01L 1/3442 123/90.17 |
| 2012/0255509 | A1 | 10/2012 | Lichti | |
| 2013/0213331 | A1 * | 8/2013 | Landersdorfer | F16D 1/0876 123/90.17 |
| 2016/0123195 | A1 * | 5/2016 | Lichti | F04C 2/3448 123/90.12 |
| 2016/0230867 | A1 | 8/2016 | Hentsch et al. | |
| 2017/0260884 | A1 * | 9/2017 | Nance | F01L 1/3442 |

FOREIGN PATENT DOCUMENTS

| | | | |
|---|---|---|---|
| JP | 11182216 | A | 7/1999 |
| JP | 2012163050 | A | 8/2012 |
| WO | 2011069835 | A | 6/2011 |

* cited by examiner

*Primary Examiner* — Devon C Kramer
*Assistant Examiner* — Kelsey L Stanek
(74) *Attorney, Agent, or Firm* — Matthew V. Evans

(57) ABSTRACT

A rotor is provided for a camshaft phaser. The rotor includes a plurality of vanes, a locking pin aperture, a vent passage connected to an end of the locking pin aperture, and an axial face configured to connect with a camshaft. The axial face defines a timing protrusion that is aligned with the vent passage or the locking pin aperture, and configured to be received by the camshaft.

20 Claims, 4 Drawing Sheets

ROTOR TIMING FEATURE FOR CAMSHAFT PHASER

TECHNICAL FIELD

Example aspects described herein relate to camshaft phasers, and, more particularly, to camshaft phasers utilized within an internal combustion (IC) engine.

BACKGROUND

Camshaft phasers are utilized within IC engines to adjust timing of an engine valve event to modify performance, efficiency and emissions. Hydraulically actuated camshaft phasers can be configured with a rotor and stator arrangement. The rotor can be connected to a camshaft and actuated hydraulically in clockwise or counterclockwise directions relative to the stator to achieve variable engine valve timing. A specific installation orientation of the rotor relative to the camshaft is typically required for proper function of the camshaft phaser.

SUMMARY

In an example embodiment, a camshaft phaser includes a stator and a rotor having vanes that form fluid chambers with the stator. The rotor includes a locking pin assembly, a locking pin aperture that receives at least a portion of the locking pin assembly, a vent passage that is connected to an end of the locking pin aperture, and an axial face configured to connect with a camshaft. The locking pin aperture can be located within one of the vanes; and, the locking pin assembly can include a locking pin and a force generator. The axial face defines a timing protrusion that is aligned with one or both of the vent passage and locking pin aperture. The timing protrusion is configured to be received by the camshaft. In a further aspect, the timing protrusion can be integrally formed with the rotor. In yet another further aspect, the stator can further comprise an endless drive band interface that is arranged to connect the stator to a power source of an internal combustion engine.

In an example embodiment, the rotor includes a perimeter wall that can be partially formed by the vanes. The axial face that is configured to connect with the camshaft can be axially offset from an axial surface of the perimeter wall. The vent passage can be formed in the perimeter wall axial surface.

In an example embodiment, the vent passage is transverse to a central axis of the locking pin aperture.

In an example embodiment, at least a portion of a bottom surface of the vent passage is coplanar with at least a portion of a top surface of the timing protrusion.

In an example embodiment, a centerline of the vent passage and a centerline of the timing protrusion are aligned.

In yet another example embodiment, a centerline of the locking pin aperture and a centerline of the timing protrusion are aligned.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
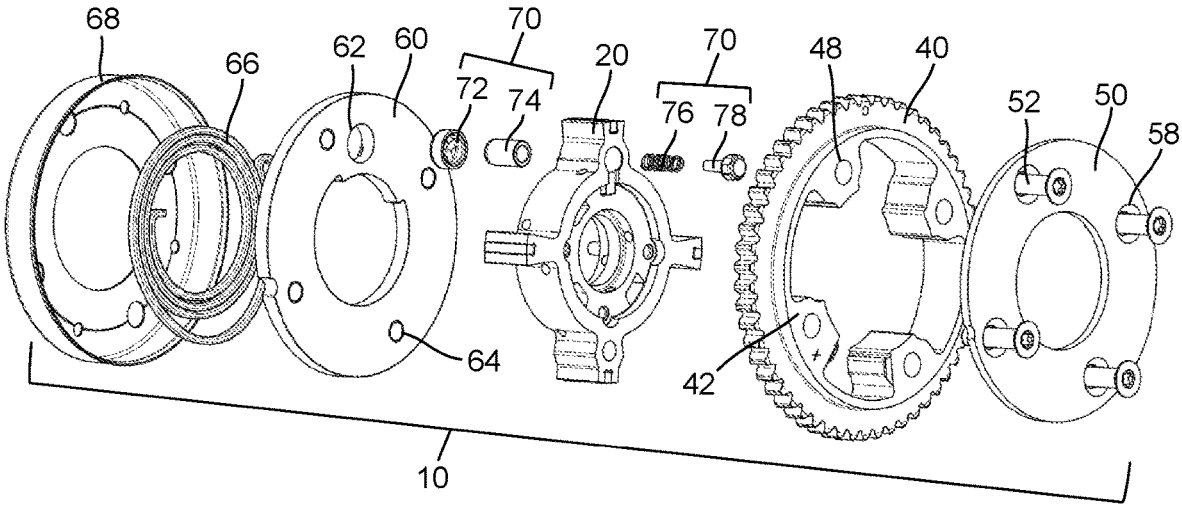
FIG. 1 is an exploded perspective view of an example embodiment of a camshaft phaser that includes a rotor that is hydraulically actuated relative to a stator.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Figure 2:
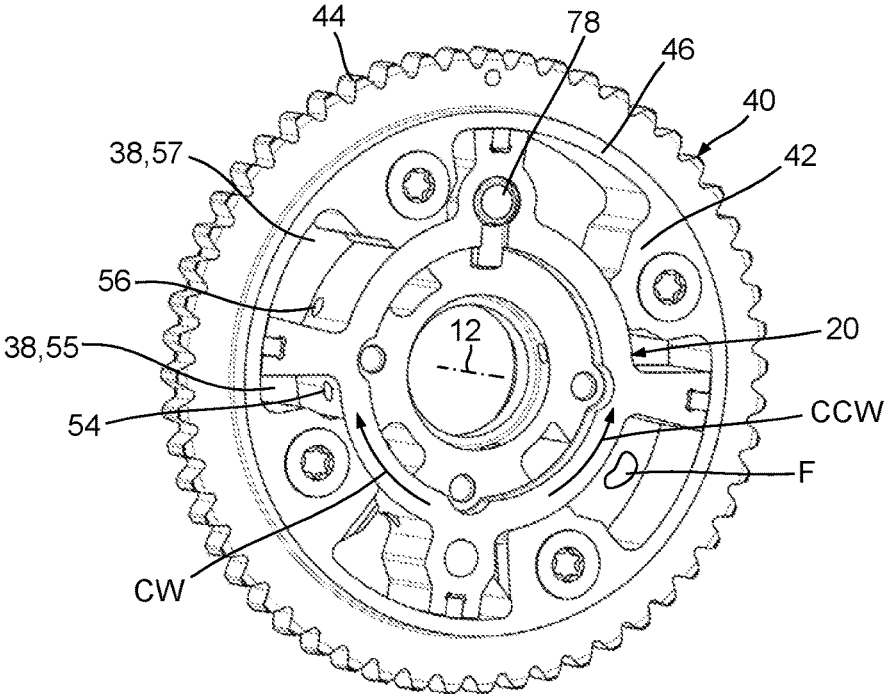
FIG. 2 is a perspective view of an assembly of the rotor and stator of FIG. 1.
Figure 3A:
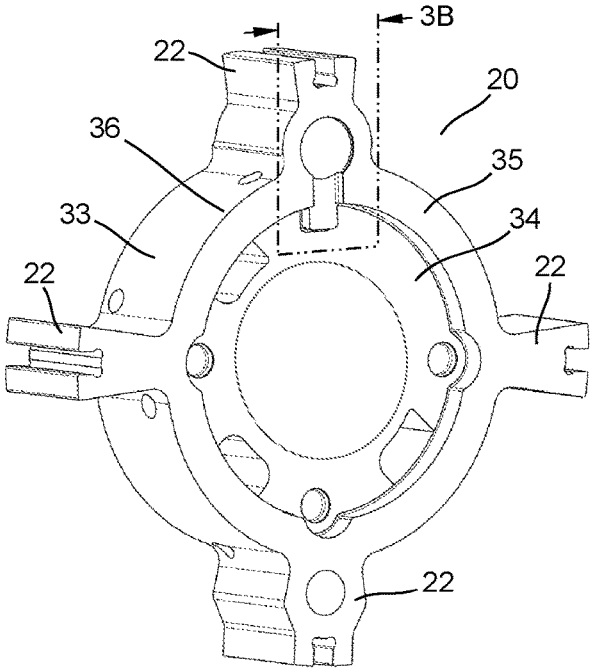
FIG. 3A is a perspective view of the rotor of FIG. 1.
Figure 3B:
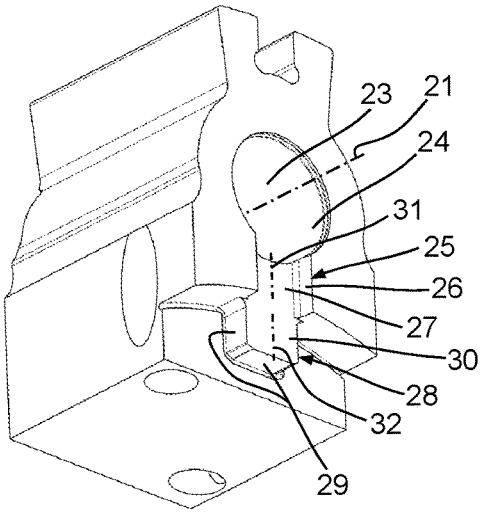
FIG. 3B is a detailed perspective view taken from FIG. 3A.
Figure 3C:
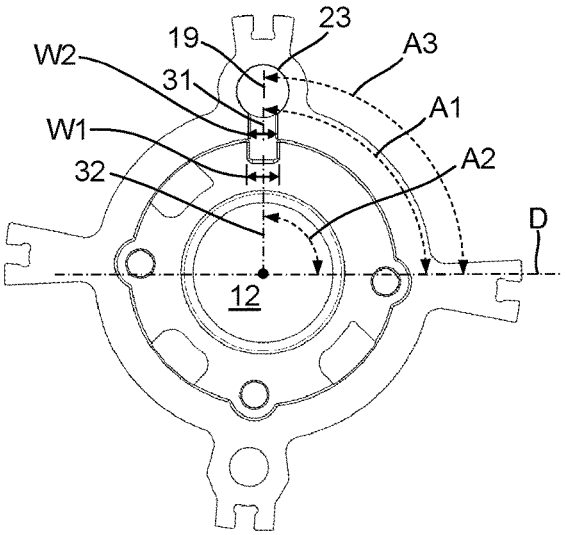
FIG. 3C is a front view of the rotor of FIG. 1.
Figure 4:
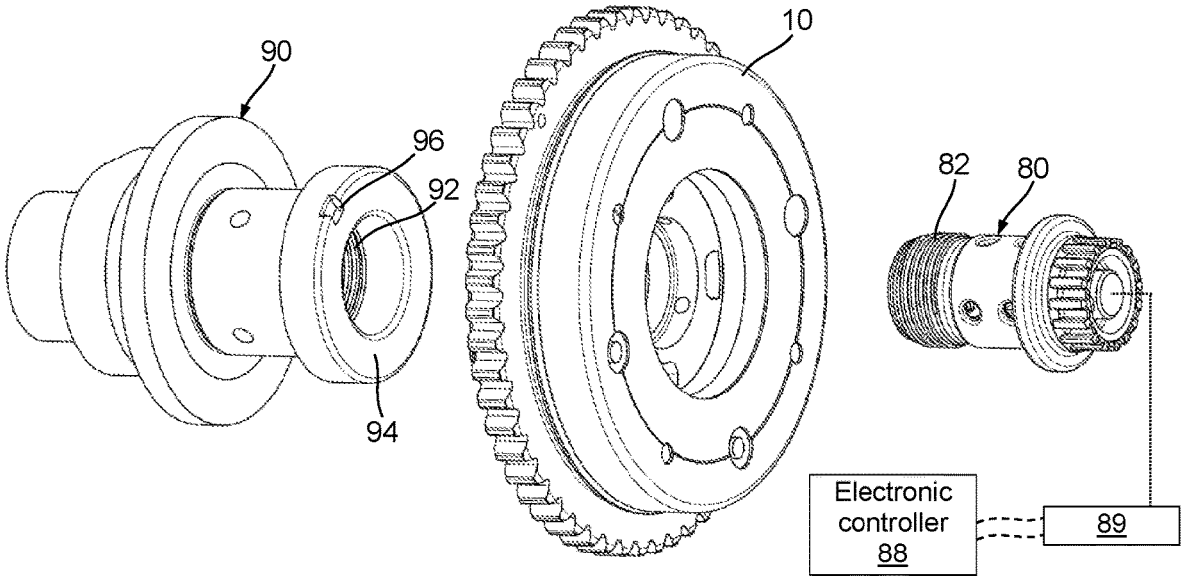
FIG. 4 is a perspective view of the camshaft phaser of FIG. 1 together with a hydraulic fluid control valve and camshaft.
Figure 5:
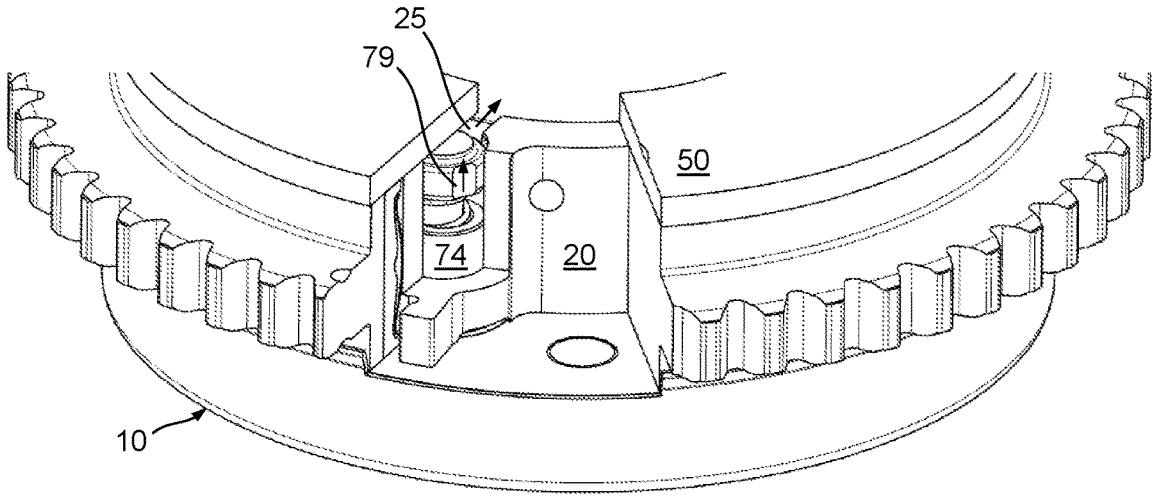
FIG. 5 is a partial perspective view of the camshaft phaser of FIG. 1 with a section removed to illustrate a hydraulic fluid path for a locking pin assembly.
Figure 6A:
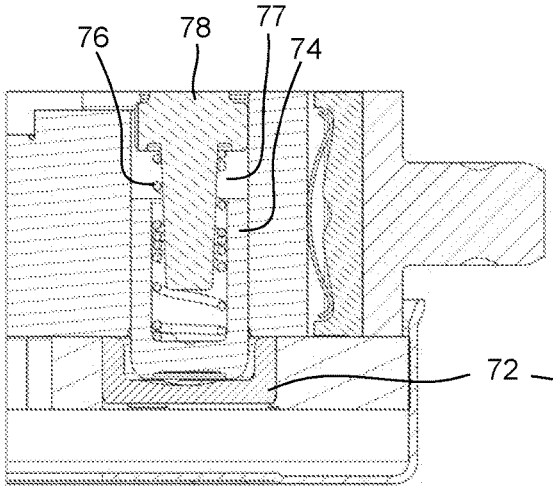
FIGS. 6A and 6B are cross-sectional views that show a locking assembly in respective locked and unlocked positions.
Figure 6B:
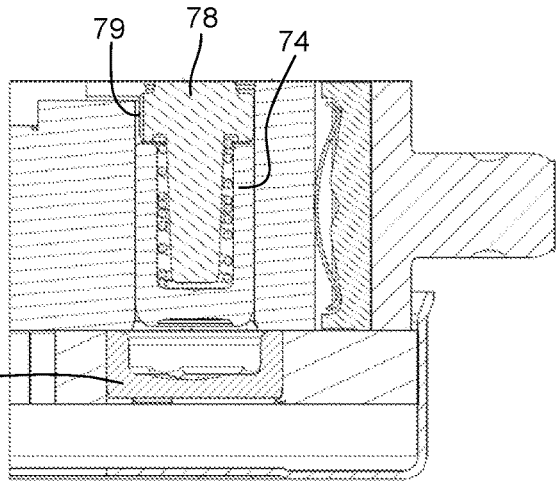

Referring to FIG. 1, an exploded perspective view of an example embodiment of a camshaft phaser 10 is shown that includes a front cover 50, a stator 40, a rotor 20, a locking cover 60, a bias spring 66, and a spring cover 68. A locking assembly 70 that can lock and unlock the rotor from the locking cover 60, is also shown within FIG. 1. FIG. 2 shows a perspective view of the rotor 20 and stator 40 of FIG. 1. FIG. 3A shows a perspective view of the rotor of FIG. 1; FIG. 3B shows a detailed view taken from FIG. 3A; and, FIG. 3C shows a front view of the rotor of FIG. 1. FIG. 4 shows the camshaft phaser 10 of FIG. 1 together with a hydraulic fluid control valve 80 and a camshaft 90. FIG. 5 shows a partial perspective view of the assembly of FIG. 1 with a section removed in the camshaft phaser 10 to show a portion of the locking assembly 70. FIGS. 6A and 6B show cross-sectional views of the locking assembly 70 in respective locked and unlocked positions. The following discussion should be read in light of FIGS. 1 through 6.

The stator 40 of the camshaft phaser 10 is configured with an endless drive band interface 44 to rotationally connect the camshaft phaser 10 to a power source (not shown), potentially to that of a crankshaft of an internal combustion (IC) engine. An endless drive band such as a belt or chain (not shown) can be utilized to facilitate this connection, causing the camshaft phaser 10 to rotate around a rotational axis 12.

A term "non-rotatably connected" can be used to help describe various connections of camshaft phaser components and is meant to signify two elements that are directly or indirectly connected in a way that whenever one of the elements rotate, both of the elements rotate in unison, such that relative rotation between these elements is not possible. Radial and/or axial movement of non-rotatably connected elements with respect to each other is possible, but not required. With this term established, the rotor 20 of the camshaft phaser 10 is non-rotatably connected to the camshaft 90, achieved by an axial clamping of the rotor 20 to the camshaft 90 via the hydraulic fluid control valve 80. The hydraulic fluid control valve 80 is configured with external threads 82 that engage internal threads 92 of the camshaft 90 to facilitate the axial clamping. Other ways to attach the rotor 20 to the camshaft 90 are also possible.

The rotor 20 includes vanes 22 that extend radially outward from a hub portion 33 of the rotor 20. The stator 40 includes protrusions 42 that extend radially inward from an outer ring portion 46 of the stator 40. A plurality of fasteners 52 extend through front apertures 58 of the front cover 50, through clearance apertures 48 of the stator 40, and attach to locking apertures 64 of the locking cover 60. The front cover 50 and locking cover 60, together with the vanes 22 of the rotor 20 and protrusions 42 of the stator 40, form hydraulic actuation chambers 38 within the camshaft phaser 10. The camshaft phaser 10 is hydraulically actuated by pressurized hydraulic fluid F that is managed by the hydraulic fluid control valve 80 to move the rotor 20 either clockwise CW or counterclockwise CCW relative to the stator 40. As the rotor 20 is connected to the camshaft 90, clockwise CW and counterclockwise CCW relative movements of the rotor 20 relative to the stator 40 can advance or retard an engine valve event with respect to a four-stroke cycle of an IC engine. With reference to FIG. 2, clockwise CW rotation of the rotor 20 relative to the stator 40 can be achieved by: 1). pressurization of a first chamber 55 via a first hydraulic fluid port 54; and, 2). de-pressurization of a second chamber 57 via a second hydraulic fluid port 56. Likewise, counterclockwise CCW rotation of the rotor 20 relative to the stator 40 can be achieved by: 1). pressurization of the second chamber 57 via the second hydraulic fluid port 56; and, 2). de-pressurization of the first chamber 55 via the first hydraulic fluid port 54. The preceding pressurization and de-pressurization actions of the first and second hydraulic fluid ports 54, 56 can be accomplished by the hydraulic fluid control valve 80. The hydraulic fluid control valve 80 is actuated to different flow states by an electromagnetic 89 which can communicate electronically with an electronic controller 88 to control the camshaft phaser 10.

The locking assembly 70 includes a locking pin 74, a force generator 76, a retainer 78, and a bushing 72. The force generator 76 can be any component that provides a force on the locking pin 74 while permitting longitudinal movement of the locking pin 74. The force generator 76 can be a bias spring, elastomer or any component that meets these described functional attributes. In an example embodiment, the locking assembly 70 can serve to either lock or unlock the rotor 20 from the stator 40, via the locking cover 60. The bushing 72 is received by a locking aperture 62 arranged within the locking cover 60. The bushing 72 can be hardened to suffice as a locking pin interface and can provide a low-cost alternative to hardening the locking cover 60. It could also be possible to eliminate the bushing 72 so that the locking pin interfaces directly with the locking aperture 62. The retainer 78 is received by and attached (possibly by an interference fit) to a locking pin aperture 23 of the rotor 20 and provides: 1). an interface for the force generator; and, 2). an outlet 79 for air and/or hydraulic fluid that is displaced within a middle chamber 77 by longitudinal movement of the locking pin 74 within the locking pin aperture 23. The outlet 79, as shown in FIGS. 5 and 6B, can be formed as one or more flats arranged on an outer circumference of the retainer 78, however, other forms are possible. A vent passage 25 is arranged at an end 24 of the locking pin aperture 23 to facilitate an exiting pathway for the air and/or hydraulic fluid that flows from the middle chamber 77 and through the outlet 79. The vent passage 25 can be arranged transverse to a center axis 21 of the locking pin aperture 23, and includes a bottom surface 27, and sidewalls 26 that extend from an axial surface 35 of a perimeter wall 36 of the rotor 20. The perimeter wall can be partially formed by the plurality of vanes 22. Other forms of the vent passage 25 are possible compared to what is shown in the Figures.

The locking assembly 70 selectively locks the rotor 20 to the stator 40 via the locking cover 60. FIG. 6A shows a first, locked position of the locking pin 74, and FIG. 6B shows a second, unlocked position of the locking pin 74. The locking assembly 70 is arranged in a "pressureless-locked" configuration, meaning that the rotor 20 will be locked to the stator 40 at hydraulic pressures below a pressure threshold provided by the locking pin 74 and force generator 76 tandem. If detachment of the rotor 20 from the stator 40 is necessary, the electronically controlled hydraulic fluid control valve 80 can be actuated to provide hydraulic fluid from a pressurized source to the locking assembly 70.

To ensure proper orientation or timing of the camshaft phaser 10 to the camshaft 90, a timing protrusion 28 is arranged on an axial face 34 or abutment surface of the rotor 20. The timing protrusion 28 is integrally formed with the rotor 20. The term "integrally formed" designates that the timing protrusion 28 is not a separate part from the rotor 20 and that it is formed during a manufacturing process of the rotor 20, such as a casting or powdered metal process. The timing protrusion 28 is configured to be received by a timing cavity 96 of the camshaft 90 during the assembly process in which the axial face 34 of the rotor 20 abuts with phaser abutment face 94 of the camshaft 90. In the example embodiment shown in the Figures, a shape of the timing cavity 96 is complementary with a shape of the timing protrusion 28, however, this does not always need to hold true.

With reference to FIG. 3B, the timing protrusion 28 includes side walls 29 that extend from the axial face 34 of the rotor 20, and a top surface 30 directly adjoined with the bottom surface 27 of the vent passage 25. It is also evident from FIG. 3B that at least a portion of the vent passage 25 extends to form at least a portion of the timing protrusion 28. The timing protrusion 28 can be aligned with the vent passage 25. The phrase "aligned with the vent passage" can designate one or both of two conditions. In a first condition shown in FIG. 3C, a centerline 32 of the timing protrusion 28 can be aligned with a centerline 31 of the vent passage 25; or, stated otherwise, the centerline 32 of the timing protrusion 28 can be angularly arranged from the datum axis D (that intersects rotational axis 12) at an angle A2, and the centerline 31 of the vent passage 25 can be angularly arranged from a datum axis D at an angle A1, with angle A1 equal to angle A2. In a second condition shown in FIG. 3B, at least a portion of the top surface 30 of the timing protrusion 28 can be aligned or coplanar with at least a portion of the bottom surface 27 of the vent passage 25.

The timing protrusion 28 can also be aligned with the locking pin aperture 23; referencing FIG. 3C, the phrase "aligned with the locking pin aperture 23" designates that the centerline 32 of the timing protrusion 28 is aligned with a centerline 19 of the locking pin aperture 23. Stated otherwise, the centerline 32 of the timing protrusion 28 can be angularly arranged from the datum axis D at an angle A2, and the centerline 19 of the locking pin aperture 23 can be angularly arranged at an angle A3, with angle A2 equal to angle A3. FIG. 3C further shows a width W1 of the timing protrusion 28 and a width W2 of the vent passage 25, such that at least a portion of the with W2 of the vent passage 25 overlaps with (or is arranged within) a width W1 of the timing protrusion.

Based on the previously described "aligned" conditions, it can be summarized that the timing protrusion 28 can be aligned with at least one of the locking pin aperture 23 or the vent passage 25; or stated otherwise, the timing protrusion 28 can be aligned with both the locking pin aperture 23 and the vent passage 25, or the timing protrusion 28 can be aligned with one of either the locking pin aperture 23 or the vent passage 25.

Figure 7:
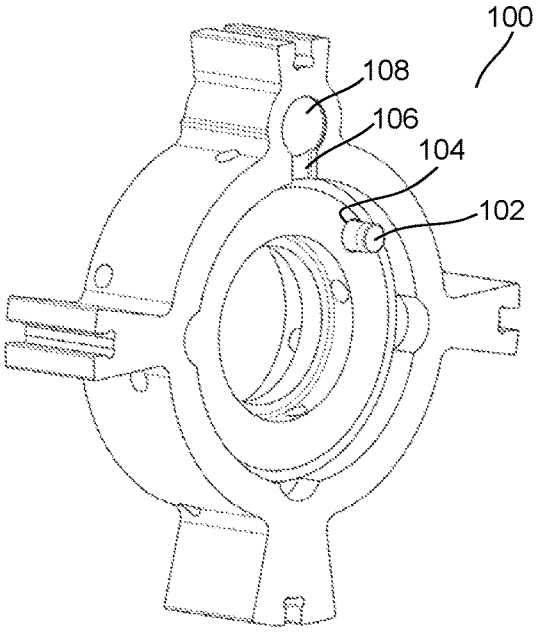
Figure 7 (PRIOR ART)
FIG. 7 is a perspective view of a prior art rotor for a camshaft phaser.

The previously described timing protrusion 28 differs from that of a prior art arrangement, shown in FIG. 7, that includes a timing pin 102 that is pressed into a blind bore 104 of a rotor 100. In this prior art arrangement, the timing pin 102 is located away from vent passage 106 and locking aperture 108, and thus, not aligned with either of these features.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser comprising:

a stator;

a rotor having:

a plurality of vanes that form fluid chambers with the stator;

a locking pin assembly;

a locking pin aperture that receives at least a portion of the locking pin assembly, the locking pin assembly configured to selectively lock the rotor to the stator;

a vent passage connected to an end of the locking pin aperture;

an axial face configured to connect with a camshaft, the axial face defining a timing protrusion configured to be received by the camshaft; and, at least a portion of the vent passage extending to form at least a portion of the timing protrusion.

2. The camshaft phaser of claim 1, wherein at least a portion of a bottom surface of the vent passage is coplanar with at least a portion of a top surface of the timing protrusion.

3. The camshaft phaser of claim 1, wherein the vent passage is transverse to a central axis of the locking pin aperture.

4. The camshaft phaser of claim 1, wherein the axial face is axially offset from a perimeter wall axial surface partially formed by the plurality of vanes.

5. The camshaft phaser of claim 4, wherein the vent passage is formed in the perimeter wall axial surface.

6. The camshaft phaser of claim 1, wherein the stator further comprises an endless drive band interface configured to connect the stator to a power source of an internal combustion engine.

7. The camshaft phaser of claim 1, wherein at least a portion of the vent passage is directly adjoined to the timing protrusion.

8. The camshaft phaser of claim 1, wherein the locking pin aperture is located within one of the plurality of vanes.

9. The camshaft phaser of claim 1, wherein the timing protrusion is integrally formed with the rotor.

10. A camshaft phaser comprising:

a stator configured to be connected to a crankshaft of an internal combustion engine;

a rotor configured to be connected to a camshaft of the internal combustion engine; the rotor having:

a plurality of vanes that form fluid chambers with the stator;

a locking pin aperture having a vent passage connected to a first end of the locking pin aperture;

an abutment surface having a timing protrusion, the timing protrusion configured to be received by a timing cavity of the camshaft; and, at least a portion of a bottom surface of the vent passage is directly adjoined with at least a portion of a top surface of the timing protrusion.

11. The camshaft phaser of claim 10, wherein a form of the timing protrusion is configured to be complementary with the timing cavity.

12. The camshaft phaser of claim 10, further comprising a locking assembly including a locking pin and a bias spring.

13. The camshaft phaser of claim 10, wherein a centerline of the timing protrusion is arranged at a first angle relative to a datum axis, the datum axis arranged orthogonally to a rotational axis of the camshaft phaser; and, a centerline of the vent passage is arranged at a second angle relative to the datum axis, the second angle equal to the first angle.

14. The camshaft phaser of claim 10, wherein the at least a portion of the bottom surface of the vent passage is coplanar with the at least a portion of the top surface of the timing protrusion.

15. A rotor for a camshaft phaser, the rotor comprising:

a plurality of vanes configured to form fluid chambers with a stator;

a locking pin aperture;

a vent passage connected to an end of the locking pin aperture;

an axial face configured to connect with a camshaft, the axial face defining a timing protrusion configured to be received by the camshaft; and, at least a portion of a width of the vent passage overlaps with a width of the timing protrusion.

16. The rotor of claim 15, wherein at least a portion of a bottom surface of the vent passage is coplanar with at least a portion of a top surface of the timing protrusion.

17. The rotor of claim 15, wherein the vent passage is transverse to a central axis of the locking pin aperture.

18. The rotor of claim 15, wherein the axial face is axially offset from a perimeter wall axial surface partially formed by the plurality of vanes.

19. The rotor of claim 15, wherein a centerline of the timing protrusion is arranged at a first angle relative to a datum axis, the datum axis arranged orthogonally to a rotational axis of the camshaft phaser; and, a centerline of the vent passage is arranged at a second angle relative to the datum axis, the second angle equal to the first angle.

20. The rotor of claim 15, wherein at least a portion of a bottom surface of the vent passage is directly adjoined with at least a portion of a top surface of the timing protrusion.

* * * * *